US007380702B2

(12) United States Patent
Oddo

(10) Patent No.: US 7,380,702 B2
(45) Date of Patent: Jun. 3, 2008

(54) SERVING BOX

(75) Inventor: Franco R. Oddo, Great Neck, NY (US)

(73) Assignee: VI Innovations, Corp., Bayside, NY (US)

( * ) Notice: Subject to any disclaimer, the term of this patent is extended or adjusted under 35 U.S.C. 154(b) by 437 days.

(21) Appl. No.: 11/015,779

(22) Filed: Dec. 17, 2004

(65) Prior Publication Data

US 2006/0131369 A1 Jun. 22, 2006

(51) Int. Cl.
*B65D 3/22* (2006.01)
*B65D 5/46* (2006.01)

(52) U.S. Cl. ..... 229/104; 229/117.24; 229/122.34; 229/902; 229/906

(58) Field of Classification Search ..... 229/104, 229/108.1, 103.3, 101.1, 120.32, 114, 117.24, 229/117.15, 122.34, 902, 906; 206/525
See application file for complete search history.

(56) References Cited

U.S. PATENT DOCUMENTS 4,494,689 A * 1/1985 Ilitch ..... 206/525
4,960,238 A * 10/1990 Lorenz ..... 229/125.29
5,476,214 A * 12/1995 Fisk, Jr. ..... 229/103
5,900,264 A * 5/1999 Gics ..... 426/107
6,752,311 B2 * 6/2004 Tulkoff ..... 229/104
7,051,919 B1 * 5/2006 Walsh ..... 229/103
2005/0199687 A1 * 9/2005 Angelopoulos et al. ..... 229/109
2006/0037957 A1 * 2/2006 Battista et al. ..... 220/23.88

* cited by examiner

*Primary Examiner*—Nathan J. Newhouse
*Assistant Examiner*—Christopher Demeree
(74) *Attorney, Agent, or Firm*—Leo G. Lenna

(57) ABSTRACT

The invention is directed to a box, namely a pizza box having a bottom wall; a peripheral side wall attached to a periphery of the bottom wall; a top cover including a rear edge hingedly attached to the side wall, a front edge, and two side edges between the front edge and the rear edge. The box is fitted with a serving tray having handles on at least two opposing sides. The serving tray is designed to fit inside the pizza box. The box may contain at least two slits in the top cover, each slit extending along the front edge, side edge or back edge. These slits are configured so that the handles from the serving tray partially fit into each slit thereby providing additional support for the overall structure of the pizza box. This allows the pizza box to be constructed of lighter material with the additional support coming from the handles of the serving tray.

15 Claims, 4 Drawing Sheets

SERVING BOX

FIELD OF THE INVENTION

The present invention relates to cardboard containers, and more particularly to pizza style containers formed from a blank fitted with a serving tray that provides additional strength to the overall structure of the box and the ability to lift the pizza out of the box for serving.

BACKGROUND OF THE INVENTION

Pizza style boxes are currently available in a wide variety of shapes and sizes. Many of the boxes include a square bottom panel, upright sidewalls, and a single lid panel that folds over the entire container. The sidewalls are typically formed as "rollover" walls that require a person to fold a first panel around a second panel and then secure the second panel into place. These boxes often need to be made out of corrugated cardboard for strength. If corrugated cardboard or a heavy gauge of cardboard is not used there is the risk that the box would not securely hold the pizza. In other words, the lighter boxes can not be stacked when full with pizza since the heat would soften the boxes and cause them to collapse.

A pizza parlor is often faced with the decision to either pay for the more expensive boxes, which is reflected in the price of the pizza, or use the cheaper boxes and risk damage to the pizza during delivery or while the customer is transporting the pizza home. In addition, many pizza parlors will use hundreds of pizza boxes at a single location during the dinner and evening hours making it necessary to assemble the boxes ahead of time during these rush periods.

If the lighter boxes are used, the owner is faced with the dilemma of whether the lighter boxes containing pizza can be stacked high enough so that they fit in the limited usually available in a pizza parlor or slow down pizza sales during the busiest time of the day. Most pizza parlor owners choose to pay for the more expensive heavier gauge corrugated boxes so that the problems stated above are mitigated. To do so, the pizza parlor owner will pay as much as two times as much per box than the lighter material box which he has to either take out of his profit margin or pass the additional cost onto the consumer in the price of the pizza.

Another disadvantage with the current pizza boxes used today no matter if they are corrugated or non-corrugated is that when the boxes are placed on a dinner table they are big and bulky. In fact, anyone that eats pizza knows that the common method of serving pizza in a home, at a party, or at work, is to place the pizza box on the table, open the box and tear the top of the box off so as to expose the pizza for consumption. This method is accepted by many, but is not preferred especially when the pizza is being served at a child's birthday party or at a party at the office. The torn box method is not only difficult to do but the often unevenly ripped box looks terrible.

Getting the pizza out of the box and onto a serving tray is virtually impossible with the current boxes available today. The problems associated with tarring the cover of the box is only compounded when the heavier/corrugated boxes are used. Therefore, the pizza parlor owner solves one problem by using the more expensive boxes but presents another problem to consumer when they try to tear the box in order to serve it. Either way, the inability to serve the whole pizza is a problem that does not go away.

What is needed is a box that overcomes these problems as well as others. The current invention does just that. The pizza-serve™ box of the present invention is a two piece system that includes a pizza box and a serving tray that fits inside the box in which the pizza is placed on before the box is closed. The pizza-serve™ box is cheaper than the heavier corrugated box but yet solves the existing problems discussed above. The serving tray that is placed in the box adds support to the overall structure of the box and therefore allows for a cheaper lighter gauge box to be used. Using the non-corrugated box with the tray allows the box to be cheaper but yet has the strength of the more expensive heavier/corrugated box.

Secondly, the serving tray allows the consumer to easily and safely remove the pizza from the box and place the pizza on the table for consumption. The serving tray makes the method of tearing the cover off of the box to expose the pizza obsolete.

In addition, the pizza parlor does not need to use wax paper on the bottom of the box like is commonly done today to prevent oil from seeping through the box because the serving tray will provide that function. This is yet another way the pizza parlor owner saves real money that goes right to the bottom line. All-in-all, the pizza box of the present invention solves the problems with the current pizza boxes, provides additional features and cost less money than using the alternative corrugated boxes used today.

SUMMARY OF THE INVENTION

The present invention is directed to a food box comprising a serving tray for removing the item of food from the box to a table or counter so that it can be served to be eaten. More particularly, the invention is directed to a pizza box containing a serving tray with handles that can used to lift the pizza out of the box and provides additional structural support for the entire box. The additional structural support provided by the serving tray allows a pizza parlor to use the cheaper non-corrugated material to make the box without the worry of structural collapse.

The box of the present invention comprises a bottom wall, a peripheral side wall attached to a periphery of the bottom wall, and a top cover attached to a rear edge of the side wall. The rear edge of the top cover is hingedly attached to the side wall so that the top cover can be opened and closed. The box must also comprise a serving tray having a bottom wall that is smaller than the bottom wall of the box so that the serving tray fits inside the box. The actual construction of a box can change according to what type of food item is placed inside the box. For purposes of this invention, the size and shape of the box used can change but as long as the box used is fitted with a serving tray it is deemed to fall with the scope/spirit of the present invention.

In one embodiment of the invention, the serving tray that fits inside the box is designed to have at least two handles projecting upward from the bottom wall so as to permit the consumer to lift the pizza out of the box and set the tray down with the pizza on a table for consumption. The serving tray can be designed so as to have a slight lip around the entire tray so as to prevent the pizza from slipping off of the serving tray while it is being carried to a dinner table and/or served.

In another embodiment of the invention, the box is equipped with at least two slits, each slit extending along the opposing edges of the top cover whereby the handles of the serving tray interlock into the slits and provide additional support for the overall structure of the box. This is important because it allows the box to be made of a cheaper material while still maintaining strength.

The box can be constructed of corrugated or non-corrugated cardboard, while the serving tray can be constructed of a material selected from the group consisting of corrugated cardboard, plastic, new age material, and composite material. The box of the present invention may be constructed so that the peripheral side wall attached to the periphery of the bottom wall has a height substantially the same as the upper edge of the peripheral side wall when the top cover is closed. The box may also contain at least one vent opening.

No matter what type of material the serving tray of the invention is made of, it must be strong enough so as to support the weight of the food item it is intended to be used with. For example, if the serving tray is constructed of corrugated cardboard then the corrugation lines must be perpendicular to the handles so that when the pizza is lifted, the serving tray does not fold or collapse. If the serving tray is made of plastic then the gauge of the plastic used must be thick enough to support the same.

The serving tray should be a light color, such as white, so that heat from the pizza will reflect off of the tray and not make the pizza or other hot item placed on the tray soggy from condensation. If a cold item, such as a cake, is placed on the serving tray then the color of the serving tray is less important.

DETAILED DESCRIPTION OF THE INVENTION

The box/serving tray combination of the present invention can be used for any type of food that needs to be taken out of a delivery box and served on the table. In particularly, the present invention is directed to a pizza delivery box having a serving tray so that the pizza can be taken out of the box and served.

Pizza is served at many parties, gatherings, functions and often at least one meal a month in almost every household in America. When pizza is delivered it is always in the common pizza box many Americans have grown to recognize. Once the pizza is placed in the box at the pizza parlor it is cut and is almost impossible to be removed as a whole pie from the box by the consumer once it is delivered. Therefore, either the pizza is placed in the kitchen and everyone grabs a slice on a plate and brings it to the table or more commonly the top portion of the box is torn away from the box and the torn box is used to serve the pizza.

Tearing the box is not as easy as it sounds since the boxes are usually corrugated so as to support the weight of the pizza. Often the box does not tear evenly and sometimes the pizza is damaged during the tearing of the box. This method, although not easy, or perfect is often used by the pizza eating community since no alternative until now has been available. The pizza-serve™ box of the present invention deals directly with the problem stated above.

The pizza-serve™ box of the present invention is designed to have a serving tray that fits within the pizza box and is used to place the pizza upon. Once the pizza is delivered, the consumer can easily lift the pizza out of the box by using the handles on the serving tray and place it on the table for consumption. The box can then be discarded. The serving tray eliminates the consumer eating pizza from a bulky box placed on a table. Using the present invention, the pizza is lifted out of the box by the serving tray and is served.

Figure 1:
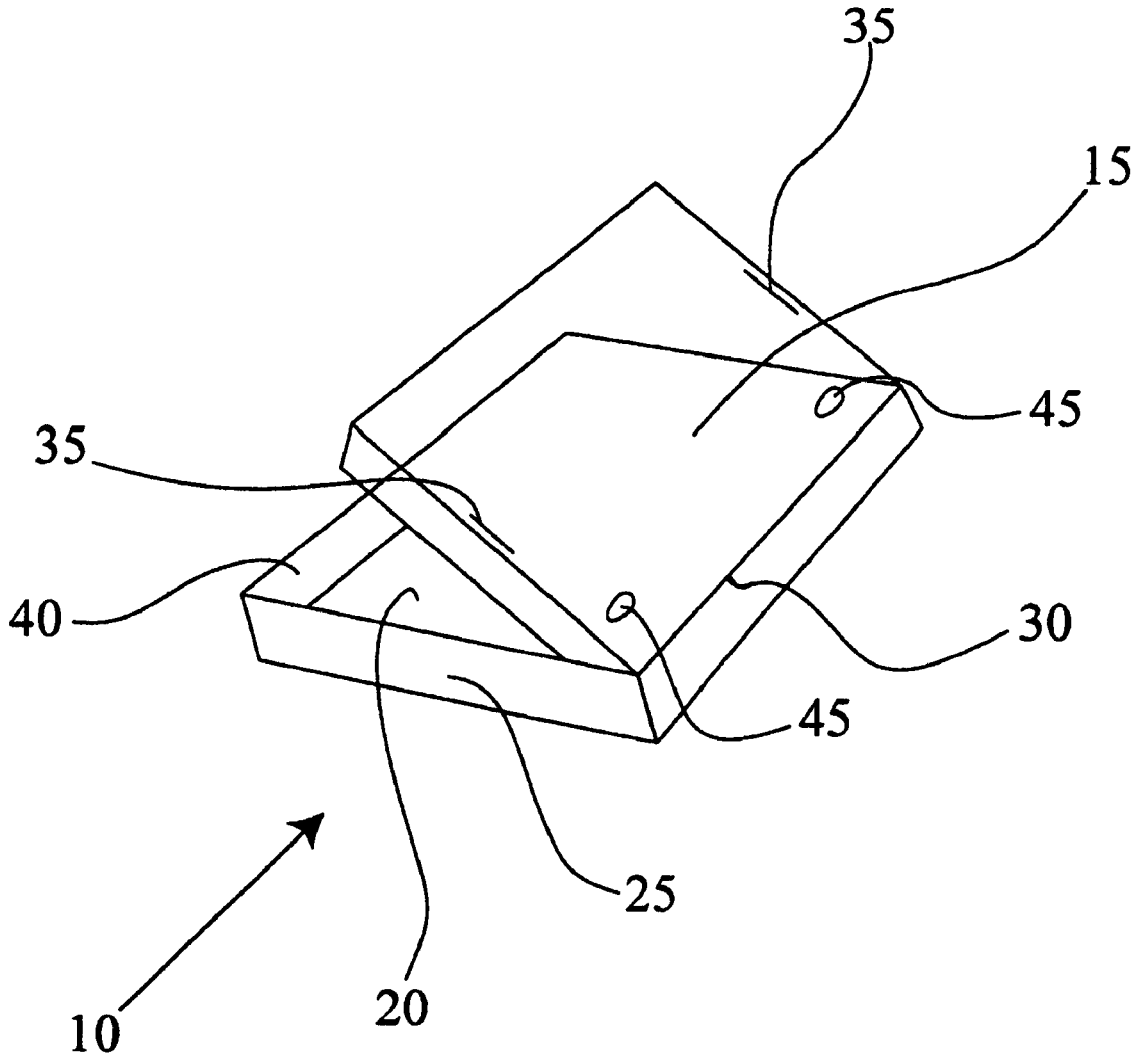
FIG. 1 is an overall view of the box of the invention.
(10) Box of the invention
(15) Top of box
(20) Bottom surface of box
(25) Side edge of box
(30) Back Hinge of box
(35) Slit for handle of tray
(40) Front edge of box
(45) Vent holes

FIG. 1 of the present invention shows a top view of the box of the invention without the serving tray. It is noted that although the box shown is a pizza box, any shape and/or size box can be used. The box (10) of the present invention has a top surface (15), a bottom surface (20), a side edge (25), a front edge (40) and a back hinge (30). The box is usually produced as a flat blank and is folded into shape prior to use. Various types of boxes can be used without deviating from the spirit of the invention.

The pizza box can also be equipped with vents (30) and slits for the handles of the serving tray (35). The slits are formed parallel with the edge of the top portion of the box and are designed so that the handles of the serving tray can interlock into the slits to provide additional support for the overall structure of the box. Since the serving tray adds additional support to the box, a cheaper lighter material can be used to make the box. When the serving tray is inserted into the box and the handles interlocked into the slits, the serving tray provides the support necessary to carry the pizza. This design saves on the cost of the box but yet provides additional features.

Figure 2:
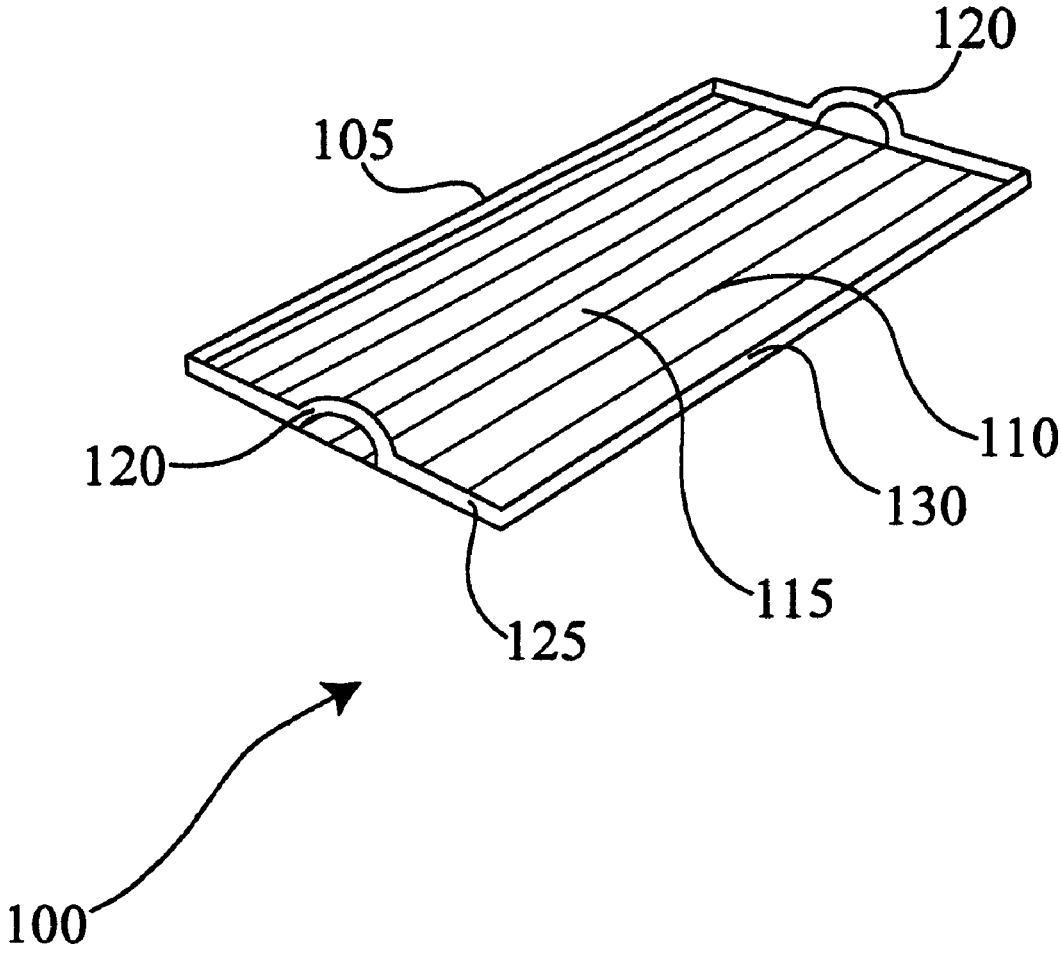
FIG. 2 is a top view of the serving tray of the invention.
(100) Serving tray
(105) Front lip of the serving tray
(110) Corrugation lines of the serving tray
(115) Surface of serving tray
(120) Handles of serving tray
(125) Side lip of serving tray
(130) Back lip of serving tray

FIG. 2 shows a top view of the serving tray of the invention. The serving tray of the invention (100) comprises at least two handles (120) but can be made with four handles that would be located on each side of the serving tray. The handles (120) of the serving tray must be strong enough so that when the tray is lifted from the box, the weight of the pizza does not cause either the handles or the body of the serving tray to collapse. The serving tray may also have a front lip (105) and a back lip (130) that is designed to keep the pizza in place when carrying it from the box to the table. The front (105) and back (130) lips also provide additional support to the box when the serving tray is in the box.

As stated above, the serving tray (100) must be strong enough to support the weight of a pizza so that it does not collapse when the pizza is lifted out of the box. One way to achieve the necessary strength when using cardboard, the material most often used for boxes, is to use corrugated cardboard. When corrugated cardboard is used, the corrugation lines must run perpendicular to the handles (110). Having the corrugation lines of the serving tray (110) run perpendicular or almost perpendicular to the handles will prevent the serving tray from folding in from the weight of the pizza. The surface of the serving tray (115) can be coated with wax or another oil resistant material so that the serving tray will be resistant to oil and wax paper need not be used in the pizza box.

In one embodiment of the invention, the surface of the serving tray (115) is white so as to reflect the heat of the pizza and not cause it to get soggy during delivery. In addition, as mentioned above, since the serving tray is being placed in the box, it is not necessary to use the customary wax paper to cover the bottom wall of the box so as to prevent oil from leaking through the box. This is another way that the pizza-serve™ box saves money for the pizza business owner. Many other types of materials can be used to make the serving tray such as plastic, foil, corrugated cardboard, non-corrugated thick gauge cardboard, compressed board, man-made materials, composites and the like, all of which are anticipated and fall within the scope of the invention.

Figure 3:
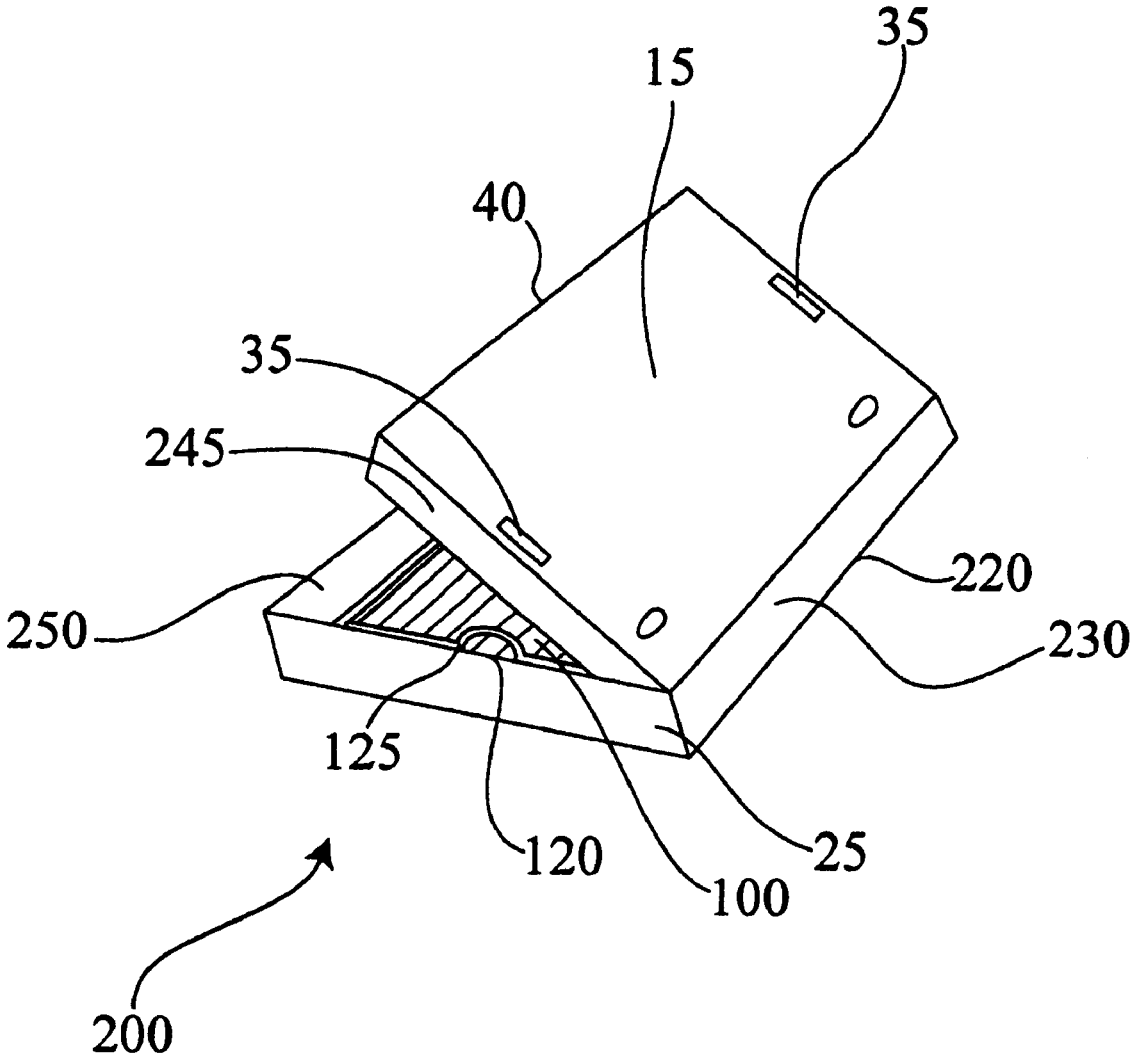
FIG. 3 is a top view of the serving tray inside a box.
(200) Serving tray inside box
(15) Top of box
(125) Side lip of serving tray
(100) Serving tray
(120) Handle of serving tray
(25) Side edge of box
(230) Back edge of box
(35) Slit for handle of serving tray
(40) Front edge of box
(245) Side edge of top of box
(250) Front edge of bottom portion of box

FIG. 3 shows the serving tray within the box (200). The box and the serving tray (200) have all of the features described above for the box (FIG. 1) and the serving tray (FIG. 2). The box of the invention has a top surface (15), a bottom surface (255), a side edge of the bottom (25), a front edge of the bottom (250), a side edge of the top (245), a front edge of the top (40) hinged together by a back hinge (230). The top (15) is designed to fit within the bottom portion (255) of the box so as to form a closed unit. Inside the box is the serving tray having an edge (125), a bottom surface (100) and at least two handles (120) (only one show in this view).

The pizza-serve™ box of the present invention may also have slits (35) in the top (205) of the box so that the handles of the serving tray interlock as described above. The top (205) and the bottom of the box are hinged together by the back hinge (230). With the box open, the serving tray is placed into the box and the pizza is placed on top of the serving tray. Once in position, the box can be closed and the handles locked into the slits for support. At this time the pizza is ready for delivery. Once the pizza reaches its destination it can be served using the serving tray.

Figure 4:
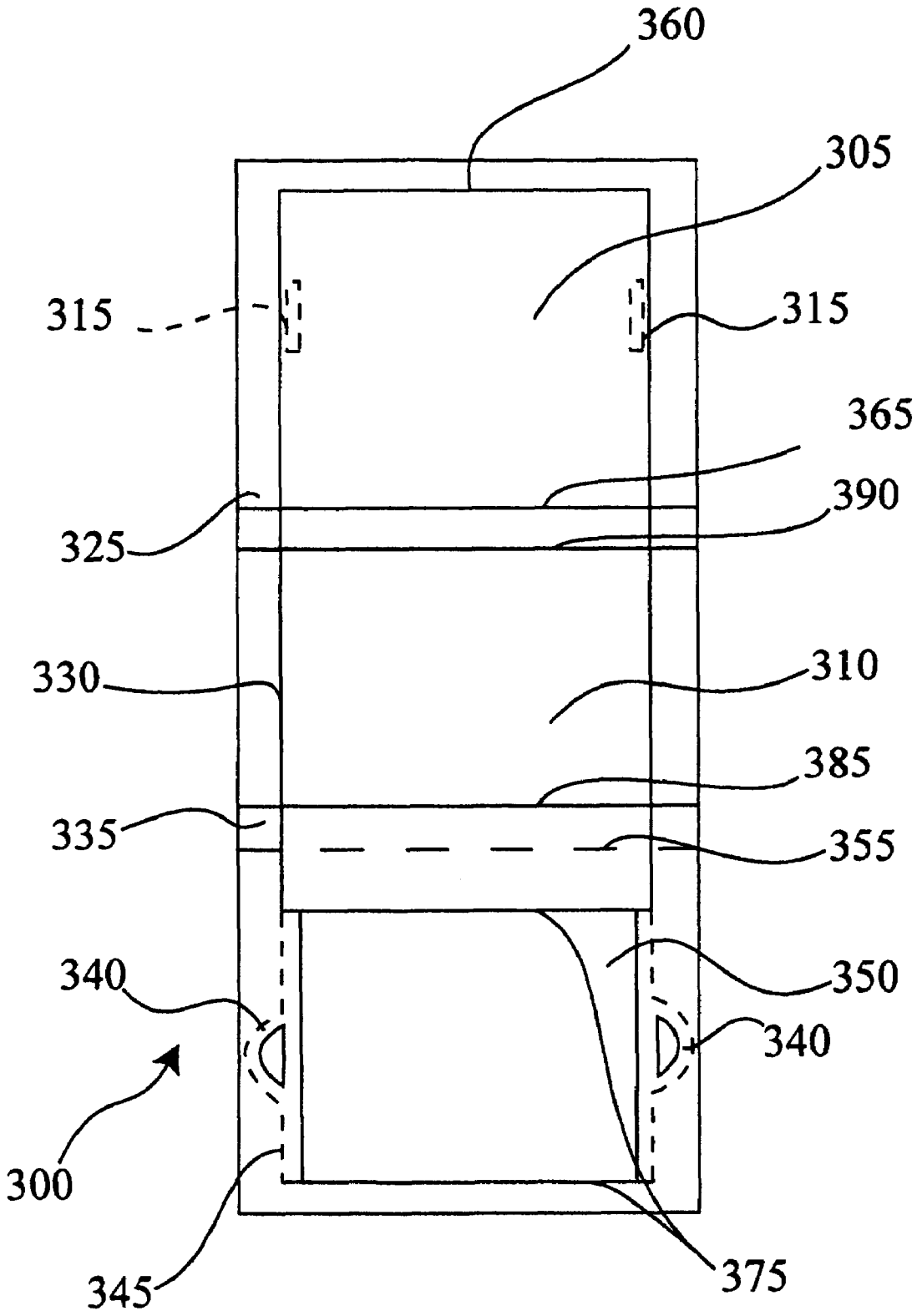
FIG. 4 is a top view of a box/serving tray blank.
(300) Blank for box with serving tray
(305) Top portion of box
(310) Bottom portion of box
(315) perforated slit for handles of serving tray
(320) Fold-line for side edge of top of box
(325) Side edge of top of box
(330) Fold line for side edge of bottom of box
(335) Side edge of bottom of box
(340) Handle of serving tray
(345) Perforation to reveal handle of serving tray
(340) Handle of serving tray
(350) Surface of serving tray
(355) Perforated tear line to remove serving tray from box
(360) Fold-line for front edge of box
(365) Fold-line for hinge between top and bottom of box
(370) Fold-line to form lip of serving tray
(380) Fold-line to form lip of serving tray
(385) Fold-line for back edge of box

Most boxes are produced by a die cut. In other words, a large machine using hydraulic force cuts multiple sheets of cardboard at one pass. These boxes are then assembled and used. FIG. 4 shows a blank for the pizza-serve™ box of the present invention.

In particular, FIG. 4 shows a top view of a blank of the present invention. The blank for the pizza-serve™ box of the present invention (300) has the serving tray attached as an additional portion that can be torn away on the perforation and placed inside the box. This is only one way the pizza-serve™ box of the present invention can be produced. The serving tray of the present invention can also be produced separately from the box. Since much of the cost of making the box is setting up the die machine to make the proper cuts, cutting the tray/box in one pass may save enough money so that the tray and box can both be cut out of corrugated cardboard in one pass and still be less expensive than cutting them separate.

The blank (300) comprises a top portion (305) that is delineated by a fold line for a front edge (360) two fold lines on each side (320) and a fold line between the top (305) and bottom (365) portions of the box. The top portion of the box (305) may also have slits for the handles (320). Continuing down the one piece blank (300) the bottom (310) portion of the box is reached. The bottom portion is delineated by the fold lines of the side edges of the bottom (330), the fold line between the top (305) and bottom (365) portions of the box, fold line for back edge of box and the perforated tear off line for the serving tray (355). Once the serving tray is torn away from the rest of the blank, the box can be assembled by folding each of the fold lines and interlocking each edge and the top and bottom portions to make a pizza box.

The torn away serving tray has at least two handles (340) that are outlined with perforated lines. The unnecessary portions of cardboard around the handles can be removed and discarded. Once the excess material is removed from around the serving tray, the tray is now smaller than the assembled box and therefore fits comfortably into the box. The serving tray also has side fold lines (370) that once folded along; place the handles substantially perpendicular to the surface of the tray. The remaining fold lines (375) when folded up produce the rest of the non-slide lip. The lip is designed to interlock with the lip of the handles to make a complete serving tray.

If corrugated cardboard is used to make the blank, as stated above the corrugation lines must run perpendicular to the handles. In addition, if the blank (300) is used, as stated above a light color should be used so as not to cause the pizza to get soggy. Once the box is assembled and the serving tray formed the tray can be placed into the box and is ready for pizza.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiment and modes of practice.

What is claimed is:

1. A box comprising:

a bottom wall;

a peripheral side wall attached to a periphery of said bottom wall;

a top cover attached to a rear edge of said peripheral side wall, said rear edge hingedly attached to said peripheral side wall, a serving tray having a bottom wall that is smaller than said bottom wall of said box so that said serving tray fits inside said box and is in direct communication with the bottom wall of said box and said serving tray has at least two handles projecting upward from said bottom wall so as to provide an easy carrying means for said serving tray; and wherein said top cover of said box comprises at least two slits, each of said at least two slits extending along the opposing edges of said top cover whereby said handles interlock into said slits to support the overall structure of said box and to keep the contents of the box from coming in contact with said top portion of said box.

2. A box according to claim 1, wherein said serving tray is constructed of a material selected from the group consisting of plastic, foil, corrugated cardboard, non-corrugated thick gauge cardboard, compressed board, man-made materials, and composite material.

3. A box according to claim 2 wherein said serving tray is constructed of corrugated cardboard and the corrugation support lines of the cardboard run perpendicular to said handles of said serving tray.

4. A box according to claim 1, wherein said peripheral side wall attached to said periphery of said bottom wall has a height substantially the same as said upper edge of said peripheral side wall when said top cover is closed.

5. A box according to claim 4, further comprising at least one vent opening.

6. A box according to claim 1 wherein said serving tray further comprises a raised lip around the perimeter of said bottom wall of said serving tray.

7. A box according to claim 6, wherein an item placed on said serving tray is positioned on said bottom wall of said serving tray so that said lip inhibits sliding of said item within said box.

8. A box according to claim 6 wherein said serving tray is a light color.

9. A box according to claim 8 wherein the color of said serving tray is white.

10. A blank for a box comprising:

a bottom wall;

a peripheral side wall attached to a periphery of said bottom wall;

a top cover attached to a rear edge of said side wall, said rear edge hingedly attached to said side wall, and a serving tray having a bottom wall that is attached by at least one edge to at least one edge of said bottom wall of said box, said bottom wall of said serving tray is perforated with the design of at least two handles and configured so that said serving tray rests on said bottom wall of said box, said edge of said bottom wall of said serving tray is attached to at least one edge of said bottom wall of said box, said edge between said serving tray and said bottom wall of said box is perforated so that said serving tray can be separated from said bottom wall of said box and said top cover of said box further comprises at least two slits, each of said slits extending along the opposing edges of said top cover whereby said handles can interlock into said slits to support the overall structure of said box.

11. The blank for a box according to claim 10 wherein said peripheral side wall attached to said periphery of said bottom wall is a height substantially the same as said upper edge of said peripheral side wall when said top cover is closed.

12. The blank for a box according to claim 11 wherein the blank for the box is constructed of corrugated cardboard and the corrugation support lines of the cardboard run perpendicular to said perforated handles of said serving tray.

13. The blank for a box according to claim 12 comprising at least one vent opening.

14. The blank for a box according to claim 12 wherein the blank is a light color.

15. The blank for a box according to claim 14 wherein the blank is white.

* * * * *